US011352108B2

(12) United States Patent
Huang et al.

(10) Patent No.: US 11,352,108 B2
(45) Date of Patent: Jun. 7, 2022

(54) FULL-FACE DIVING MASK

(71) Applicant: BESTWAY INFLATABLES & MATERIAL CORP., Shanghai (CN)

(72) Inventors: Shuiyong Huang, Shanghai (CN); Bo Wu, Shanghai (CN); Yuyan Liu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 98 days.

(21) Appl. No.: 16/666,706

(22) Filed: Oct. 29, 2019

(65) Prior Publication Data

US 2020/0130792 A1 Apr. 30, 2020

(30) Foreign Application Priority Data

Oct. 29, 2018 (CN) ..... 201821763012.X

(51) Int. Cl.
*B63C 11/16* (2006.01)
*A62B 9/02* (2006.01)
*A62B 18/10* (2006.01)

(52) U.S. Cl.
CPC ..... *B63C 11/16* (2013.01); *A62B 9/02* (2013.01); *A62B 18/10* (2013.01); *B63C 2011/165* (2013.01)

(58) Field of Classification Search
CPC .. A61M 16/20; A61M 16/208; A61M 16/209; B63C 11/00; B63C 11/02;
(Continued)

(56) References Cited

U.S. PATENT DOCUMENTS

2010/0132701 A1* 6/2010 Fukasawa ..... B63C 11/205 128/201.11
2011/0146675 A1* 6/2011 Chen ..... B63C 11/205 128/201.11
(Continued)

FOREIGN PATENT DOCUMENTS

CN 206141801 U 5/2017

OTHER PUBLICATIONS

Extended European Search Report, dated Mar. 13, 2020 (Mar. 13, 2020), by the European Patent Office on related European patent application 19205582.0.

*Primary Examiner* — Colin W Stuart
(74) *Attorney, Agent, or Firm* — Dickinson Wright PLLC

(57) ABSTRACT

A full-face diving mask includes a mask and a breathing tube. The mask includes an outer frame, a lens housing and a fitting mask. The fitting mask includes a partition plate. The partition plate and the inner surface of the lens housing define an observation chamber on the top and a breathing chamber below. The partition plate includes at least one air intake port to allow inhaled air to be guided and circulated through at least one air intake passageway from the observation chamber toward the breathing chamber. The breathing chamber is further provided with an air compartment partition plate connected to the partition plate to define an air discharge compartment. The air compartment partition plate is provided with at least one air discharge port to allow exhaled air to be guided through at least one air discharge passageway from the air discharge compartment and discharged along the breathing tube.

19 Claims, 11 Drawing Sheets

(58) Field of Classification Search
CPC ..... B63C 11/12; B63C 11/16; B63C 11/18; B63C 11/20; B63C 11/205; B63C 11/207; B63C 2011/123; B63C 2011/125; B63C 2011/126; B63C 2011/128; B63C 2011/165; A62B 7/00; A62B 9/00; A62B 9/02; A62B 18/00; A62B 18/02; A62B 18/025; A62B 18/04; A62B 18/08; A62B 18/082; A62B 18/084; A62B 18/10
See application file for complete search history.

(56) References Cited

U.S. PATENT DOCUMENTS

| | | | | |
|---|---|---|---|---|
| 2016/0297505 | A1* | 10/2016 | Caprice | B63C 11/16 |
| 2018/0065719 | A1 | 3/2018 | Liao | |
| 2018/0134352 | A1* | 5/2018 | Armani | B63C 11/26 |
| 2018/0297676 | A1* | 10/2018 | Zheng | B63C 11/16 |
| 2018/0319471 | A1* | 11/2018 | Thomas | B63C 11/205 |
| 2019/0023366 | A1* | 1/2019 | Liao | B63C 11/16 |
| 2019/0118915 | A1* | 4/2019 | Xiao | B63C 11/16 |
| 2019/0118918 | A1* | 4/2019 | Xiao | A61F 9/026 |
| 2021/0094662 | A1* | 4/2021 | Shiue | B63C 11/16 |

* cited by examiner

FULL-FACE DIVING MASK

CROSS-REFERENCE TO RELATED APPLICATION

This U.S. patent application claims priority to and the benefit of Chinese patent application number 201821763012.X, filed Oct. 29, 2018, the entire disclosure of which is hereby incorporated by reference.

BACKGROUND OF THE INVENTION

1. Field of the Invention

The present disclosure relates to a diving mask, and more particularly, to a full-face diving mask having a breathing tube.

2. Related Art

This section provides background information related to the present disclosure which is not necessarily prior art Water bodies provide recreational and professional outlets in various climates and regions. Recreationally, the enjoyment of water is shared by both sports and outdoor enthusiasts, among others. Professionally, water bodies provide means of transportation and shipping and an entire ecosystem of natural resources. One activity that has been quickly gaining popularity is underwater diving or snorkeling. Improvements in accessibly and advancements in the art have made diving and snorkeling popular with a wide range of people both recreationally and professionally. Diving and snorkeling are typically synonymous activities that require a diving mask, which protects a user's eyes and allows them the ability to observe their surroundings when under water. In addition to allowing a user to open their eyes under water, many diving masks also cover a user's nose and/or mouth and provide a breathing tube, allowing the user to breath when underwater. Traditional diving masks for snorkeling are generally categorized into two groups: (1) diving masks that only cover a user's eyes (and sometimes both the user's eyes and nose) and have a separate mouthpiece connected to the breathing tube and (2) full-face diving masks that cover more than a user's eyes (e.g., the user's entire face, such as at least the user's eyes, nose and mouth) and are integrated with the breathing tube. When using a diving mask, only the user' eyes and nose are covered (and some diving masks cover only the user's eyes), and the breathing tube is held by the user's mouth. When using a full-face mask, the breathing tube is integrated with the top or the side of the mask to facilitate breathing. Since a full-face mask provides a close fit with a user's face and an independent space or cavity, the user's mouth and nose can breathe freely in the independent space.

The existing full-face diving masks provide exhalation channels and inhalation channels to improve the comfort of underwater breathing, and some of the masks are provided with separate structures for the intake and discharge of gas, such as air. However, in such masks, only a single one-way valve is provided, and the intake and discharge of air cannot be effectively separated. This results in most of the exhaled carbon dioxide remaining in the user's breathing space such that the remaining carbon dioxide is re-inhaled. In addition, since exhaled air is mixed with water vapor, and a mask is oftentimes used in low temperature water, the inner surface of the mask may fog up easily as condensation forms on the inner surface of the mask.

SUMMARY OF THE INVENTION

The following outlines certain features of embodiments of the present invention such that the detailed description of the invention that follows may be better understood. Additional features of embodiments of the present invention will be described hereinafter. It should be appreciated by those skilled in the art that the general concepts and the specific embodiments disclosed herein may be readily utilized as bases for modifying or designing other embodiments for carrying out the same or similar purposes of the present invention. It should also be realized by those skilled in the art that such equivalent embodiments do not depart from the spirit and scope of the invention, as set forth in the appended claims.

According to one aspect of the disclosure, a full-face diving mask is provided. The full-face diving mask comprises a lens housing and a fitting mask sealed together at an interface. The lens housing includes a lens that is at least partially transparent and a cavity is formed by the lens housing and the fitting mask. The fitting mask includes a face opening for the placement of a portion of a user's face therethrough and into the cavity. The face opening is configured to seal against the portion of the user's face and prevent water from entering the cavity when the full-face diving mask is worn. A first partition plate divides the cavity between an upper air compartment located adjacent to the user's eyes and a lower air compartment located adjacent to the user's nose and mouth when the full-face diving mask is worn. At least one valve located on the first partition plate permitting the transfer of air from the upper air compartment to the lower air compartment and preventing the transfer of air from the lower air compartment to the upper air compartment. A second partition plate divides the lower air compartment into a front lower air compartment located between the second partition plate and the lens housing and rear lower air compartment located between the second partition plate and the face opening. At least one additional valve located on the second partition plate permitting the transfer of air from the rear lower air compartment to the front lower air compartment and preventing the transfer of air from the front lower air compartment to the rear lower air compartment.

BRIEF DESCRIPTION OF THE DRAWINGS

The drawings described herein are only for illustrative purposes of selected embodiments and are not intended to limit the scope of the present disclosure. The inventive concepts associated with the present disclosure will be more readily understood by reference to the following description in combination with the accompanying drawings wherein.

DESCRIPTION OF THE ENABLING EMBODIMENTS

Exemplary embodiments will now be described more fully with reference to the accompanying drawings. In general, the subject embodiments are directed to a full-face diving mask. However, the exemplary embodiments are only illustrative of the various features of the present invention, those skilled in the art understanding that various changes thereto may be made without departing from the full scope of the invention. Numerous specific details are set forth, such as examples of specific components, devices, and methods, to provide a thorough understanding of the embodiments of the present disclosure. It will be apparent to those skilled in the art that specific details need not be employed, that exemplary embodiments may be altered in many different forms and that neither should be construed to limit the scope of the disclosure. In some exemplary embodiments, well-known processes, well-known device structures, and well-known technologies are not described in detail.

The implementation and usage of the exemplary embodiments will be discussed in detail below. However, it should be understood that the exemplary embodiments discussed herein are merely illustrative of specific ways to implement and use the present disclosure and do not limit the scope of the present disclosure. In the description for the structural positions of various components, representations of directions such as "upper," "lower," "top" and "bottom" are not absolute, but relative.

Herein, "inner" or "inside" refers to a direction toward the user's face, and "outer" or "outside" refers to a direction away from the user's face when using the full-face diving mask. "Upper" or "Top" refers to a direction toward the top of the user's head, and "lower" or "bottom" refers to a direction toward the underside of the user's mouth and nose.

Referring to the Figures, wherein like numerals indicate corresponding parts throughout the views, the full-face diving mask 100 is intended for allowing a user to safely and comfortably breath underwater.

Figure 1:
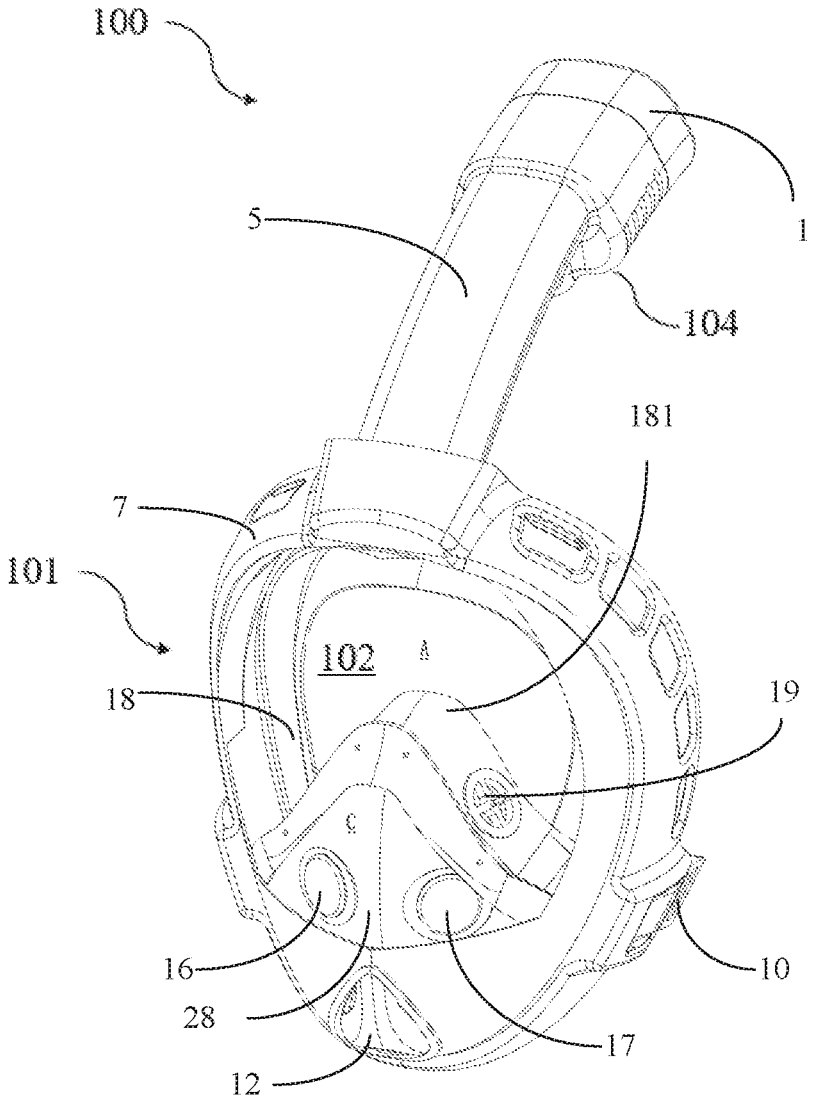
FIG. 1 is a perspective view of a full-face diving mask, according to one embodiment of the disclosure.
Figure 2:
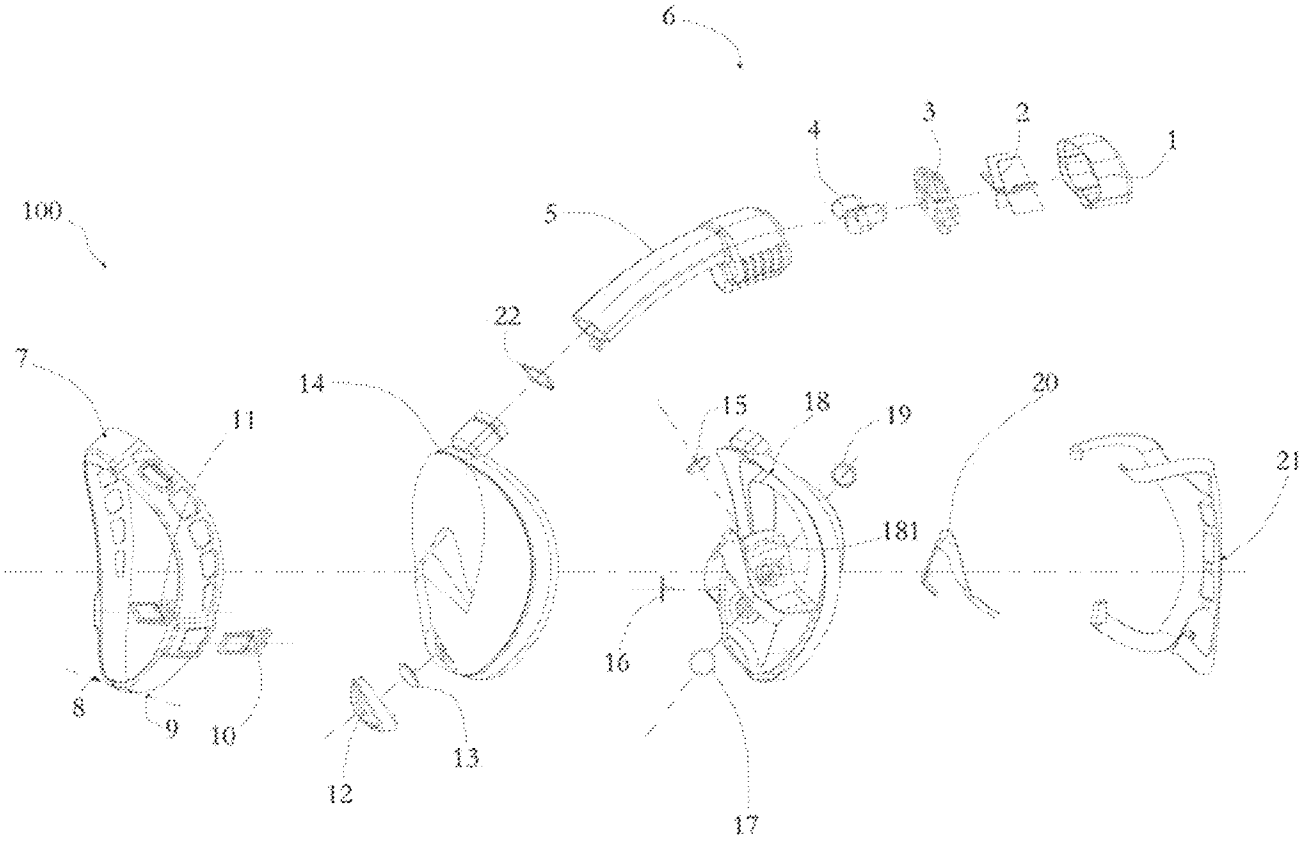
FIG. 2 is a disassembled view of the full-face diving mask.
Figure 3:
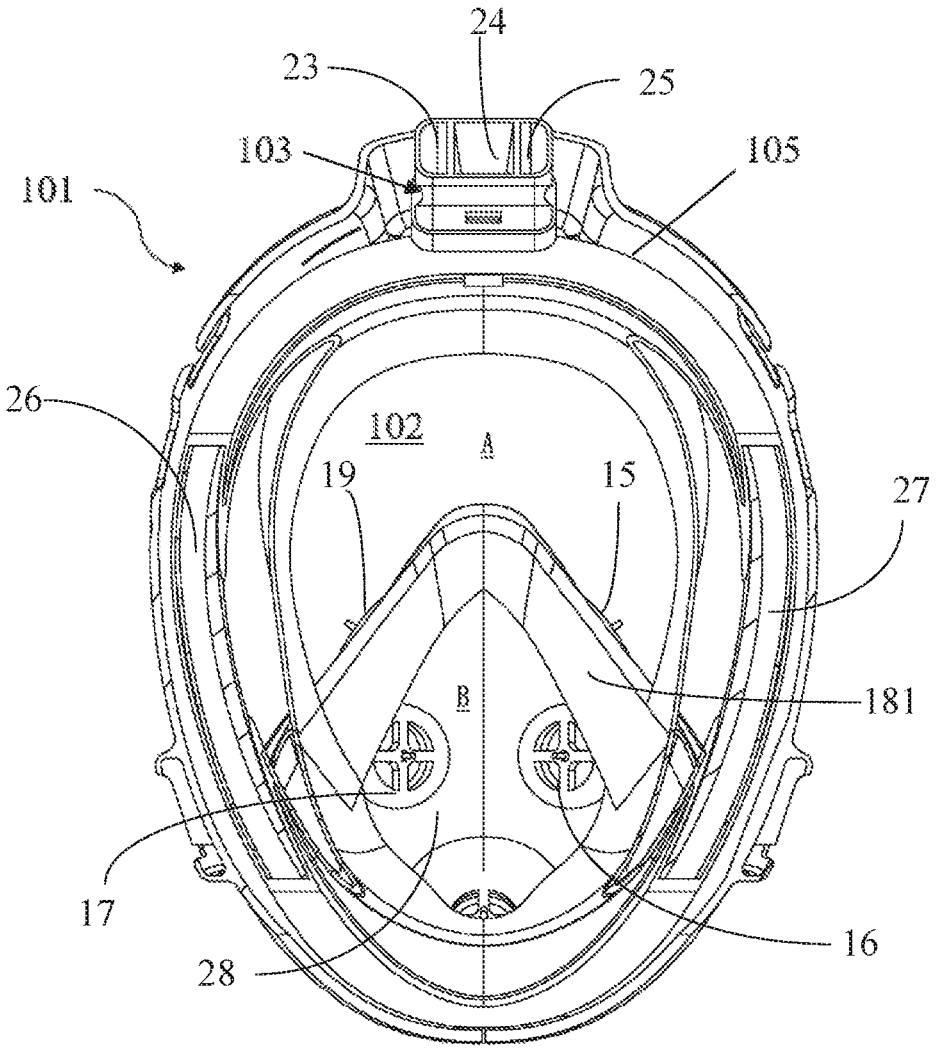
FIG. 3 is a rear view of the full-face diving mask.
Figure 4:
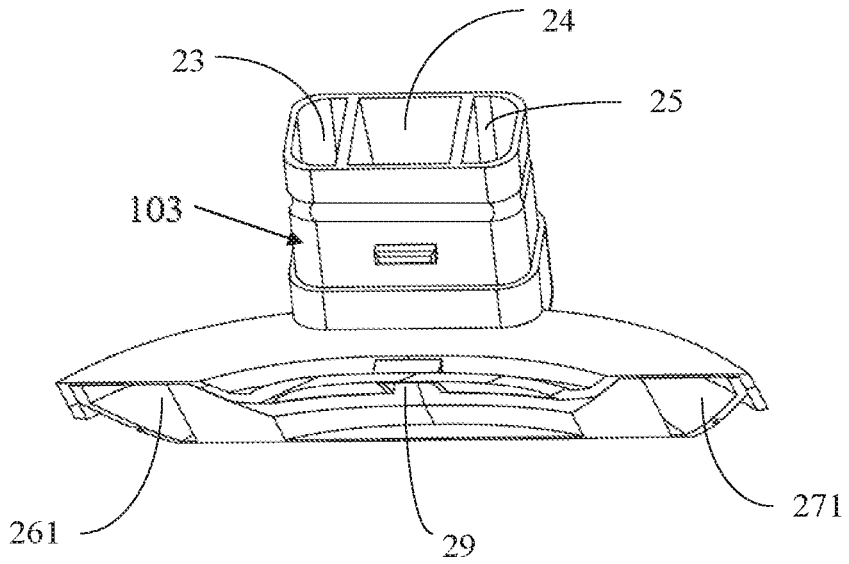
FIG. 4 is a perspective view of a connecting sleeve in the full-face diving mask for connecting the mask to a breathing tube
Figure 5:
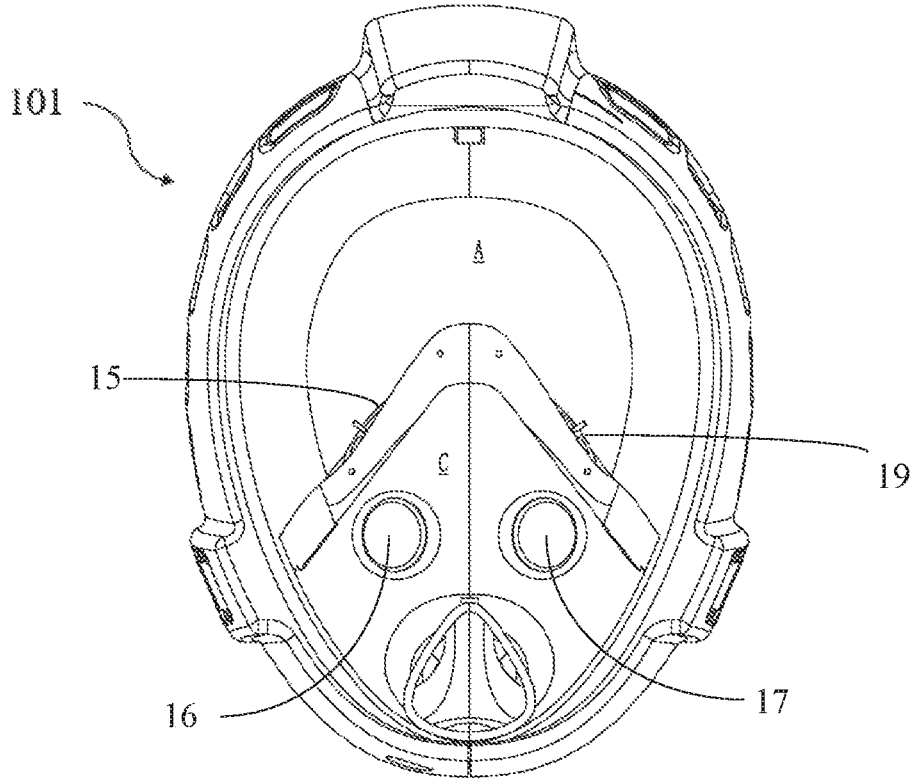
FIG. 5 is a front view of the full-face diving mask.

With initial reference to FIGS. 1 through 3, the full-face diving mask 100 is illustrated in a perspective view, a disassembled view, and a rear view, according to an embodiment of the present disclosure. The full-face diving mask 100 includes a mask 101 and a breathing tube 6 detachably connected to the mask 101 at a connection sleeve 103 (FIGS. 3 and 4). Typically, the breathing tube 6 is arranged on the top of the mask 101 to allow the user to breathe when the user has submerged into the water. The detachable connection allows for easy storage when the full-face diving mask 100 is not being used. In some embodiments and as best illustrated in FIG. 2, the mask 101 includes an outer frame 7, a lens housing 14 and a fitting mask 18. The edge of the fitting mask 18 may be sleeved to the edge of the lens housing 14. For example, the edge of the fitting mask 18 may be fixed to the inner surface of the lens housing 14 by a press-fit connection via an edge-sleeve pressing member 20. Further, the outer frame 7 may be attached to the lens housing 14, for example, by snap connection. A screw 8 and a nut 9 can be provided at the lower side of the outer frame 7 to achieve tightened fixation, thereby forming an integral mask fitting the user's face. Furthermore, an elastic headband 21 may be adjustably attached to the outer frame 7. For example, the elastic headband 21 may have a substantially X-shaped configuration with two connecting bands connectable to the top of the outer frame 7 and two connecting bands connectable to the bottom of the outer frame 7 to cover the back of the user's head, thus elastically and comfortably retaining the mask 101 on the user's head. To this end, both sides of the bottom of the outer frame 7 may be correspondingly provided with buckles 10, 11, which are connected to the connecting bands of the elastic headband 21 to adjust the connecting bands of the elastic headband 21. A cavity 102 (a combination of A, B, and C, as shown in FIGS. 3 and 5) is formed by the lens housing 14 and the fitting mask 18, the fitting mask 18 including a face opening for the placement of a portion of a user's face therethrough and into the cavity 102.

With continued reference to FIGS. 1 through 3, the fitting mask 18 may include a partition plate 181. The partition plate 181 and the inner surface of lens housing 14 define an observation chamber A (or upper compartment) and a breathing chamber B (or a rear lower compartment) below the observation chamber A. The observation chamber A corresponds to the position of the user's eyes, while the breathing chamber B corresponds to the position of the user's mouth and nose. In some embodiments, the partition plate 181 may include at least one air intake port (at least one of valves 15, 19) to allow inhaled air to be guided and circulated through at least one air intake passageway (24, 524) from the observation chamber A toward the breathing chamber B. For example, in the illustrated embodiment, a pair of air intake ports (e.g., valves 15, 19) is provided at positions on each of the two sides of the partition plate 181 corresponding to the user's cheek, and the air intake one-way valves 15, 19 are respectively provided for the pair of air intake ports, as best shown in FIG. 3. Therefore, inhaled air can only enter the breathing chamber from the pair of air intake ports (e.g., valves 15, 19).

Figure 7:
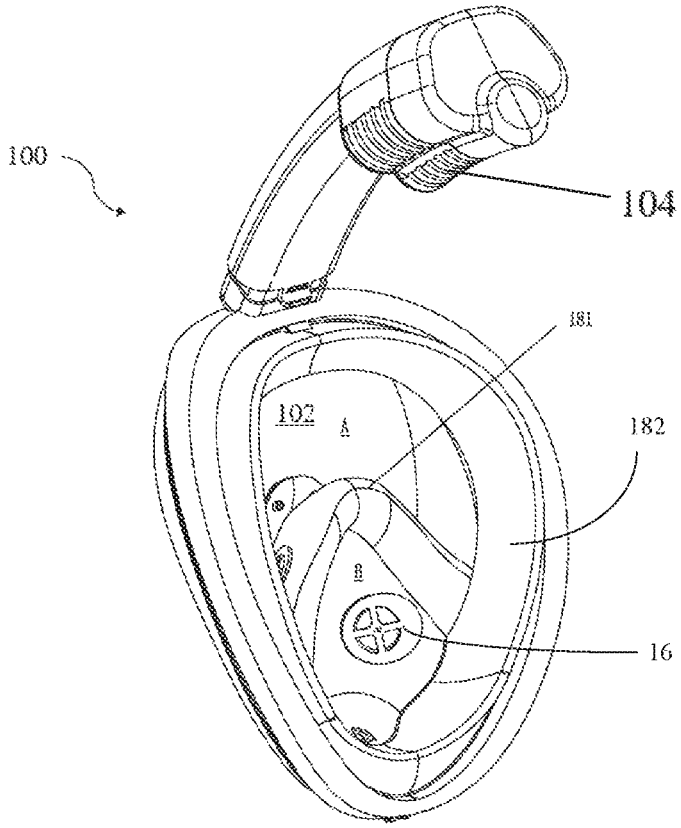
FIG. 7 is a rear perspective view of the full-face diving mask with the breathing tube attached.

According one aspect of the disclosure, the breathing chamber B is further provided with an air compartment partition plate 28. The air compartment partition plate 28 is connected to the partition plate 181 to define an air discharge compartment C (a front lower compartment). Discharge compartment C and breathing chamber B combine to form a lower air compartment (B, C). In some embodiments, a pair of air discharge ports (e.g., valves 16, 17) is provided on the air compartment partition plate 28, and an air discharge one-way valve is provided at each air discharge port to allow exhaled air to be guided through at least one air discharge passageway (23, 25, 26, 27, 523, and 525) from the air discharge compartment C and discharged along the breathing tube 6. In other words, the observation chamber A is defined by the inner surface of the lens housing 14 and the upper surface of the partition plate 181 of the fitting mask 18, and the breathing chamber B is defined by the inner surface of the air compartment partition plate 28 and the lower surface of the partition plate 181 of the fitting mask 18. The air discharge compartment C is defined by the lower surface of the partition plate 181 of the fitting mask 18 and the outer surface of the air compartment partition plate 28. In some embodiments, the partition plate 181 and/or the air compartment partition plate 28 of the fitting mask 18 may be integrally formed with the fitting mask 18. In some embodiments, the fitting mask 18 may be a flexible silicone mask including a nose-fitting surface for sealing against the user's mouth and nose and a face-fitting surface 182 for sealing against the user's face, as best shown in FIG. 7. Likewise, the partition plate 181 and/or the air compartment partition plate 28 may also be made of flexible material, and the nose-fitting surface may be formed by means of the inner surface of the partition plate 181. It should be appreciated, however, that the fitting mask 18, the partition plate 181 and the air compartment partition plate 28 may also be made of any other flexible materials to make it comfortable for the user to wear the full-face diving mask 100.

In some embodiments, the full-face diving mask 100 may include at least one air intake passageway (e.g., passageways 24, 524) and at least one air discharge passageway (e.g., passageways 23, 25, 26, 27, 523, and 525). In such instances, the breathing tube 6 may correspondingly be provided with at least one air intake channel 524 and at least one air discharge channel (e.g., channels 523, 525). The at least one air intake channel 524 may be coupled with the observation chamber A to form an air intake passageway (e.g., passageways 24, 524). The at least one air discharge channel (e.g., channels 523, 525) may be coupled with the air discharge compartment C via at least one air discharge conduit to form an air discharge passageway (e.g., passageways 23, 25, 26, 27, 523, and 525). The air discharge conduit may be provided at either side edge or both side edges of the fitting mask 18 and/or the lens housing 14. The lens housing 14 is surrounded by a lens housing peripheral edge, and the fitting mask 18 is surrounded by a fitting mask peripheral edge, wherein the interface 105 (see FIG. 3) between the lens housing 14 and the fitting mask 18 is adjacent to both peripheral edges. As such, the one or more air discharge conduits may extend adjacent to the interface 105.

The breathing tube 6 may further include an elbow 5 provided with an air intake channel 524 and an air discharge channels (e.g., channels 523, 525). The proximal end of the elbow 5 is connected to the mask 101, and the distal end of the elbow 5 is provided with an end cap 1 and an adjustment device 107 (see FIG. 11) to allow air to enter and exit the breathing tube 6 through a breathing tube opening 104, as will be described in greater detail below.

With reference now FIGS. 6 through 11, the breathing tube 6 includes an air intake channel 524, a first air discharge channel 523 and a second air discharge channel 525. The air intake channel 524 can be coupled with the observation chamber A to form the air intake passageway (e.g., passageways 24, 524). The first air discharge channel 523 and the second air discharge channel 525 may be respectively arranged on both sides of the air intake channel 524 and coupled with the air discharge compartment C to form the air discharge passageways (e.g., passageways 23, 25, 26, 27, 523, and 525). Referring now back to FIGS. 3 and 4, the fitting mask 18 and/or the lens housing 14 may include a connecting sleeve 103 connected to the breathing tube 6. The connecting sleeve 103 may include an air intake inlet 24 coupled with the air intake channel 524, and a first air discharge outlet 23 and a second air discharge outlet 25 that are respectively coupled with the first air discharge channel 523 and the second air discharge channel 525.

In certain arrangements, in order to realize coupling between the air discharge compartment C and the air discharge channels (e.g., channels 523, 525) of the breathing tube 6, a first air discharge conduit and a second air discharge conduit may be respectively provided at both side edges of the fitting mask 18 and/or the lens housing 14. As shown in FIG. 3 by way of example, a first air discharge conduit 26 and a second air discharge conduit 27 may be provided at both side edges of the fitting mask 18. One end of the first air discharge conduit 26 is coupled with the air discharge compartment C, and the other end thereof is coupled with a first air discharge conduit interface 261 (see FIG. 4) of the connecting sleeve 103 to open to the first air discharge outlet 23. One end of the second air discharge conduit 27 is coupled with the air discharge compartment C, and the other end thereof is coupled with a second air discharge conduit interface 271 (see FIG. 4) of the connecting sleeve 103 to open to the second air discharge outlet 25. In some embodiments, the air discharge conduits may be formed via recesses formed in both side edges of the fitting mask 18 near the connection interface 105. The air discharge conduits may also be constituted by separate components and arranged in both side edges of the fitting mask 18.

In an embodiment providing two air discharge conduits, a first air discharge port 17 and a second air discharge 16 port may be symmetrically provided at positions on both sides of the air compartment partition plate 28 corresponding to the user's cheek. The first and second air discharge ports 16, 17 are respectively provided with a first air discharge one-way valve 17 and a second air discharge one-way valve 16. As illustrated in FIG. 4, the connecting sleeve 103 may be provided with an air intake interface 29 coupled with the air intake inlet 24. As such, air inhaled by the user can only enter the observation chamber A from the air intake inlet 24 and the air intake interface 29, and enter the breathing chamber B via the air intake one-way valves 15, 19. Carbon dioxide exhaled by the user can only enter the air discharge compartment C from the breathing chamber B via the first air discharge one-way valve 17 and the second air discharge one-way valve 16, and in turn enter the first air discharge conduit 26 and the second air discharge conduit 27. Then the carbon dioxide or other exhaled gases can enter the first air discharge channel 523 and the second air discharge channel 525 of the breathing tube 6 via the first air discharge outlet 23 and the second air discharge outlet 25 of the connecting sleeve, and finally be discharged from the breathing tube 6.

The air intake passageway (e.g., passageways 24, 524) and the air discharge passageway (e.g., passageways 23, 25, 26, 27, 523, and 525) of the full-face diving mask 100 of the present disclosure are separated from each other, and the intake and discharge of air can only be performed along the passageways in the fixed directions. The air discharge compartment C is closer to the user's mouth and nose, such that the air discharge process can be shortened. Thereby, the carbon dioxide or other exhaled gases can be discharged out of the full-face diving mask 100 more quickly and thoroughly, and accumulation of carbon dioxide or other exhaled gases inside the full-face diving mask 100 is greatly reduced, such that the discomfort caused by insufficient oxygen inhalation for the user is effectively avoided, and the formation of fog is reduced. This one-way design also avoids potential safety hazards from water flowing into the mask.

Various working principles and processes of the intake and discharge of air by means of the full-face diving mask 100 will be described with reference to FIGS. 6 through 11.

Figure 6:
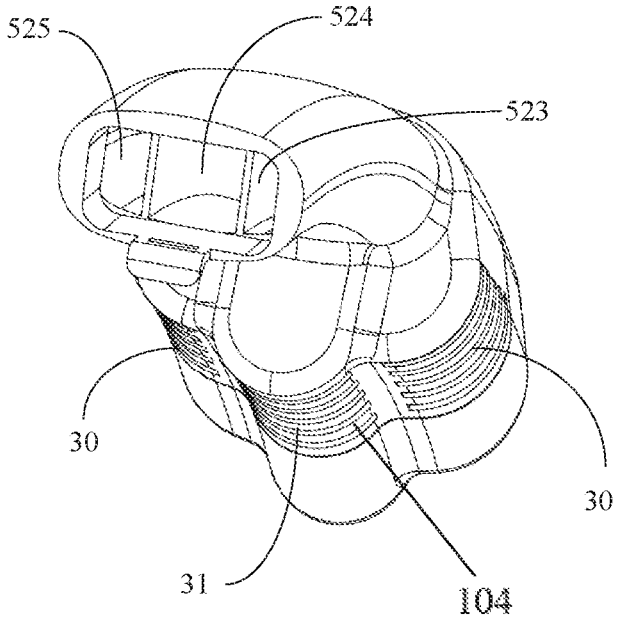
FIG. 6 is a perspective view of the breathing tube unattached from the full-face diving mask.
Figure 11:
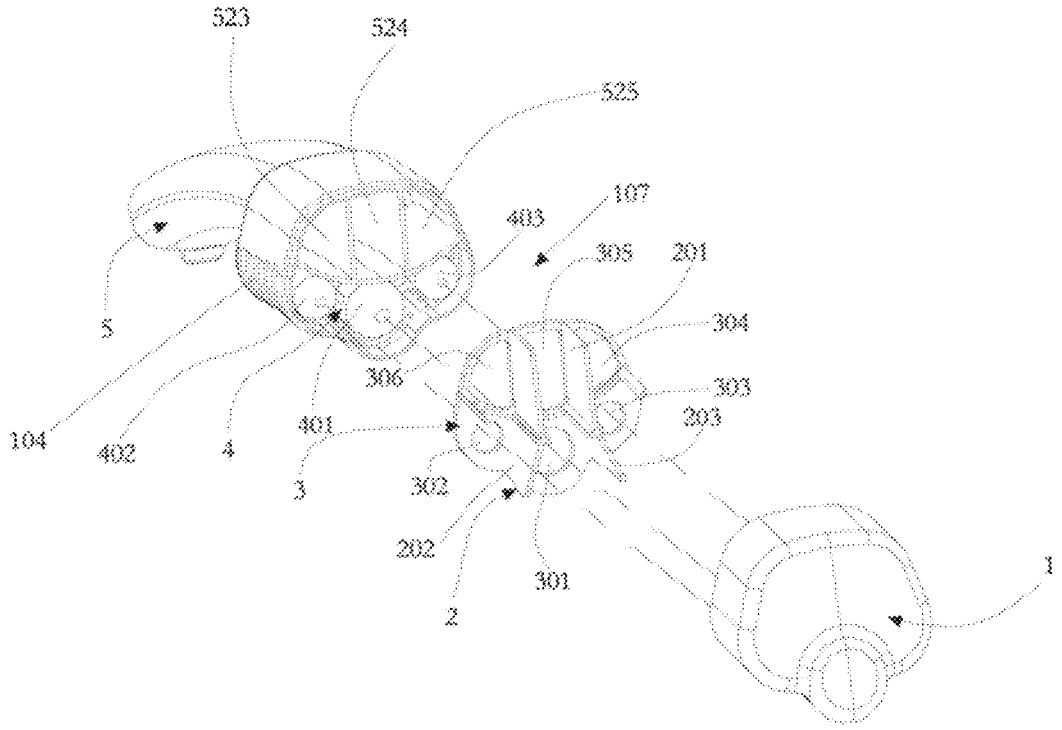
FIG. 11 is a disassembled view of the breathing tube.

As described above, the distal end of the breathing tube 6 is provided with the adjustment device 107 that allows air to enter and exit the breathing tube 6. As best seen in FIG. 11, the adjustment device 107 may include a sealing plate 3 corresponding to the sections of the air intake channel 524, the first air discharge channel 523 and the second air discharge channel 525 of the elbow 5. In other words, the sealing plate 3 has corresponding holes 305, 306, 304. The adjustment device 107 also includes an air intake opening 31 coupled with the air intake channel 524. The adjustment device 107 further includes air discharge openings 30 communicated with the first air discharge channel 523 and the second air discharge channel 525. In the illustrated embodiment, the air intake opening 31 and the air discharge openings 30 may open into the atmosphere by a plurality of slits though the outer wall. As best shown in FIG. 6, the air intake opening 31 is formed by a plurality of slits 31 and the air discharge openings 30 are formed by a plurality of slits 30 located on both sides of the slits 31. The slits 30, 31 combine to form a breathing tube opening 104. Accordingly, the sealing plate 3 has holes 301, 302, 303 (or entry control point 301 and exit control point 302, 303) corresponding to the air intake opening 31 and the air discharge openings 30 sized to seal against floaters 4. Floaters 4 are located in a caged portion 109 (FIG. 9) defined by the breathing tube opening 104, adjustment device 107, and end cap 1. Of note, the entry control point 301 is larger and so is the associated floater 4 than exit control point 302, 303 and its associated floaters 4. Further, the adjustment device 107 includes floaters or floater members 4 mated with the sealing plate 3 at an entry control point (e.g., hole 301) and an exit control point (e.g., holes 302, 303). The floaters 4 bring the air intake channel 524 into or out of communication with the air intake opening 31 and bring the air discharge channel (e.g., channels 523, 525) into or out of communication with the air discharge opening 30. For example, as shown in FIG. 11, the floaters 4 may include an air intake floater 401 provided at the air intake opening, and a first air discharge floater 402 and a second air discharge floater 403 provided at the air discharge openings. Thus, for example, when the air intake floater 401 abuts against the hole 301 on the sealing plate 3, the air intake passageway (e.g., passageways 24, 524) can be sealed. Each floater 4 may be connected to one another or be separate.

As shown best in FIG. 11, the adjustment device 107 may further include an air permeable member 2 mated with the sealing plate 3. The air permeable member 2 may be configured as a flow-guiding plate perpendicular to the sealing plate 3 to define a plurality of flow-guiding grooves 201, 202 for guiding air to enter or exit. For example, an air intake flow-guiding groove 201, a first air discharge flow-guiding groove 202, and a second air discharge flow-guiding groove 203 may be provided.

Figure 8:
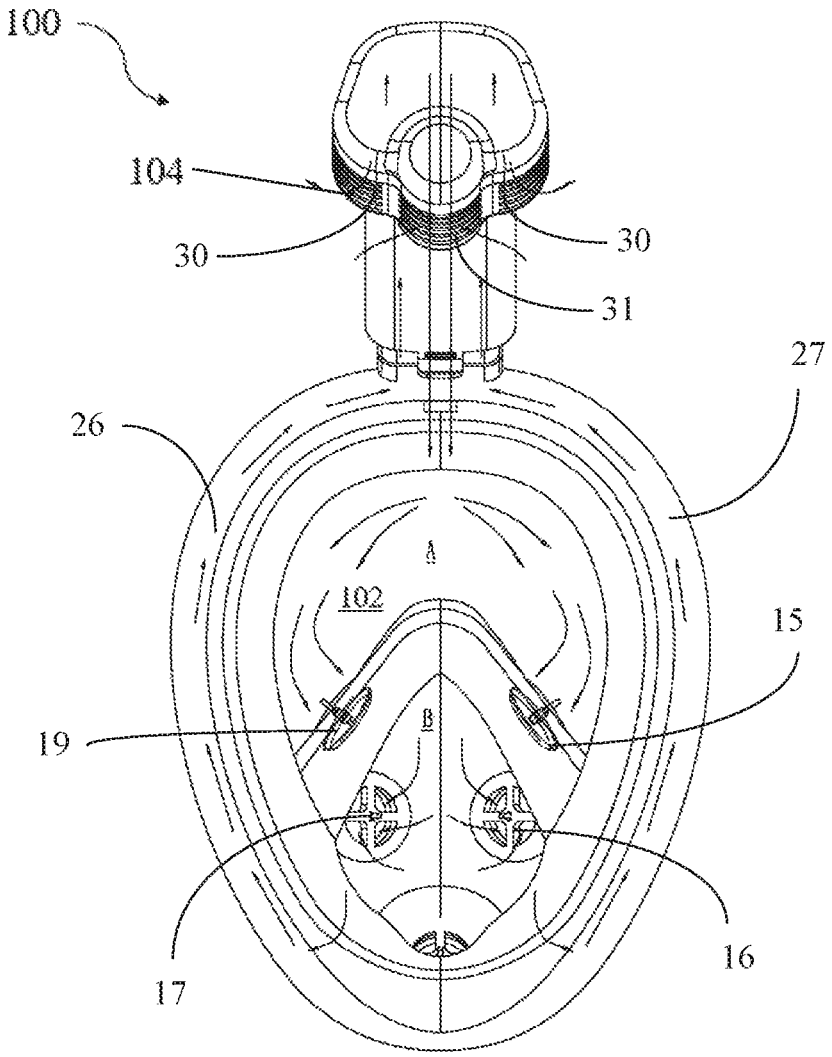
FIG. 8 is a rear view of the full-face diving mask showing air flow paths during inhalation and exhalation.
Figure 9:
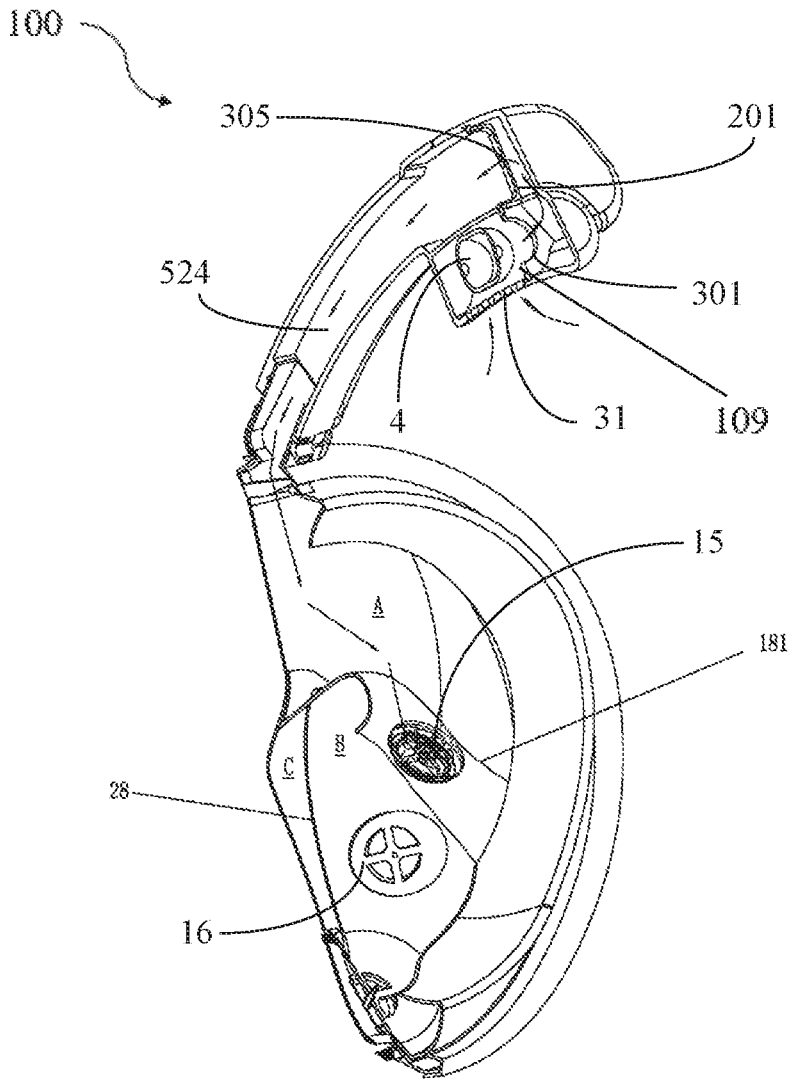
FIG. 9 is a side sectional view of the full-face diving mask showing the air flow paths during inhalation.

The air flow path in the inhalation phase is shown in conjunction with directional arrows provided in FIGS. 8 and 9. When the user inhales, the air intake one-way valves 15, 19 are opened and the air discharge one-way valves 16, 17 are closed. Fresh air is inhaled in the direction of the arrows via the air intake opening, and enters the air intake flow-guiding groove 201 via the hole 301 of the sealing plate 3. Then, the fresh air enters the air intake channel 524 of the elbow 5 via the hole 305, enters the observation chamber A, and enters the breathing chamber B via the air intake one-way valves 15, 19. Thereby, the user can inhale fresh air.

Figure 10:
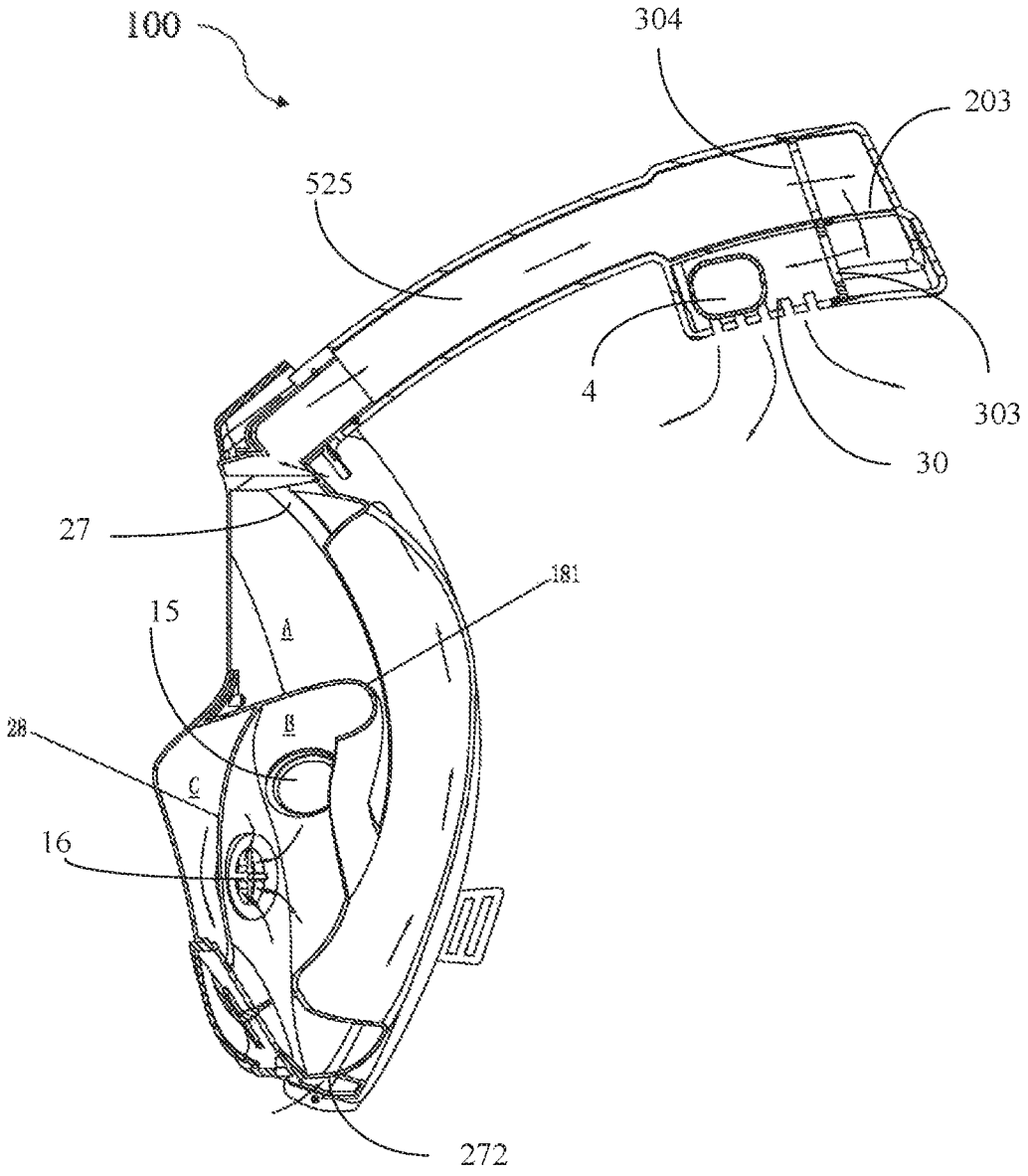
FIG. 10 is a side sectional view of the full-face diving mask showing the air flow paths during exhalation.

The air flow path in the exhaling phase is shown in conjunction with directional arrows provided in FIGS. 8 and 10. When the user exhales, the air intake one-way valves 15, 19 are closed, and the air discharge one-way valves 16, 17 are opened. The discharged air can only be discharged into the air discharge compartment C from the breathing chamber B via the air discharge one-way valves 16, 17, and enter the air discharge conduit. The air discharge conduit 26, 27 may be directly communicated with the air discharge compartment C. FIG. 10 illustrates an embodiment wherein one end of the second air discharge conduit 27 may be communicated with the second air discharge channel 525, and the other end 272 thereof may be communicated with the air discharge compartment C. It should be understood that the first air discharge conduit 26 may have the same structural arrangement. In this way, exhaled air can be discharged through the air discharge one-way valve 16 and enter the air discharge compartment C. Then, the exhaled air is discharged along the second air discharge conduit 27, the second air discharge channel 525 and the hole 304 in the sealing plate 3. In turn, the exhaled air is discharged along the second air discharge flow-guiding groove 203 of the air permeable member 2, and finally discharged out of the full-face diving mask 100 via the hole 303 and the air discharge opening 30. Thus, a breath cycle is formed in accordance with the above travel paths.

Figure 12:
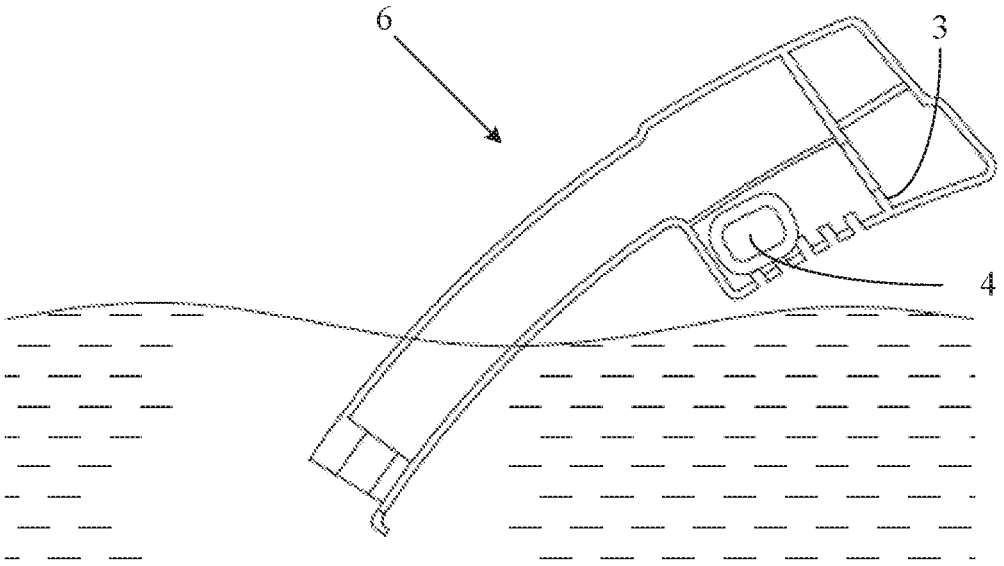
FIG. 12 is a sectional view of the breathing tube not immersed in water.
Figure 13:
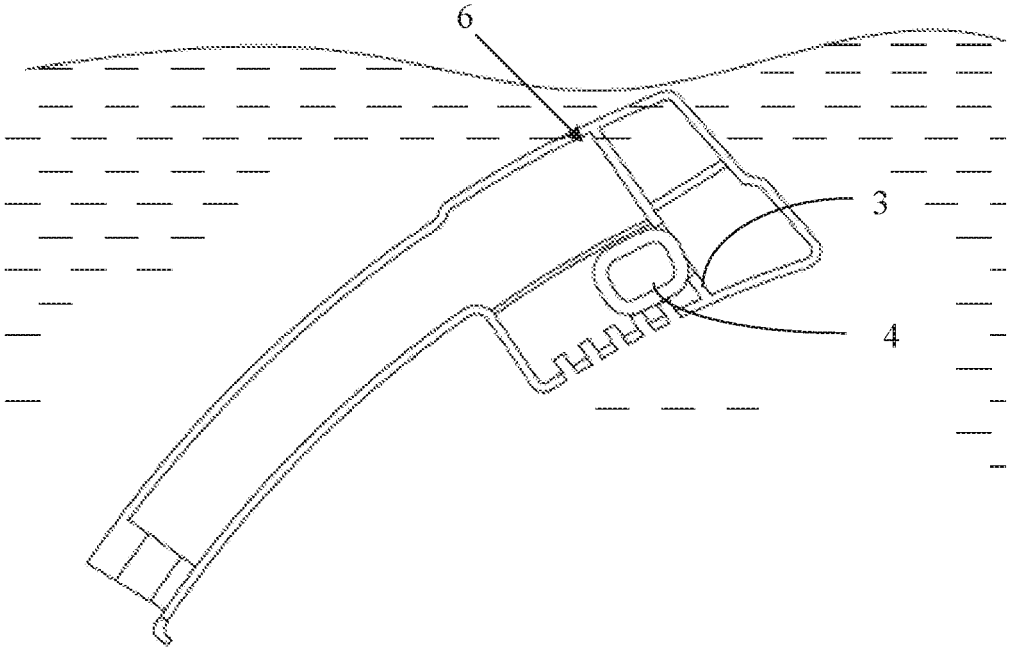
FIG. 13 is a sectional view of the breathing tube immersed in water.

It should be understood that in the inhalation or exhalation state, the floaters 4 should be out of sealing engagement with the sealing plate 3, such that the air intake opening is coupled with the air intake channel 524 or the air discharge opening is coupled with the air discharge channel (e.g., channels 523, 525) allowing the flow of air therethrough. With reference now to FIG. 12, when the breathing tube 6 is above the water surface, the floaters 4 move downward under the action of gravity to be out of sealing engagement with the sealing plate 3. The air intake channel and the air discharge channels (e.g., channels 523, 525) are opened, and air can enter and exit the breathing tube. When the user has submerged (that is, the breathing tube is beneath the water surface, as shown in FIG. 13), the floaters 4 move upward under the action of buoyancy to be in close fit with the holes of the sealing plate 3, such that the air intake channel 524 and the air discharge channels (e.g., channels 523, 525) are closed. As such, the full-face diving mask 100 is in a state of isolation from the outside environment during deeper dives to prevent water from entering the inside of the full-face diving mask 100 via the air intake channel 524 or the air discharge channel (e.g., channels 523, 525). However, it should be noted that, the user can still exhale smoothly when the breathing tube 6 is beneath the water surface, since the flow of the exhaled air can counteract the buoyancy acting on the floaters 4 and create a high pressure that prevents or slows water entry.

Figure 14:
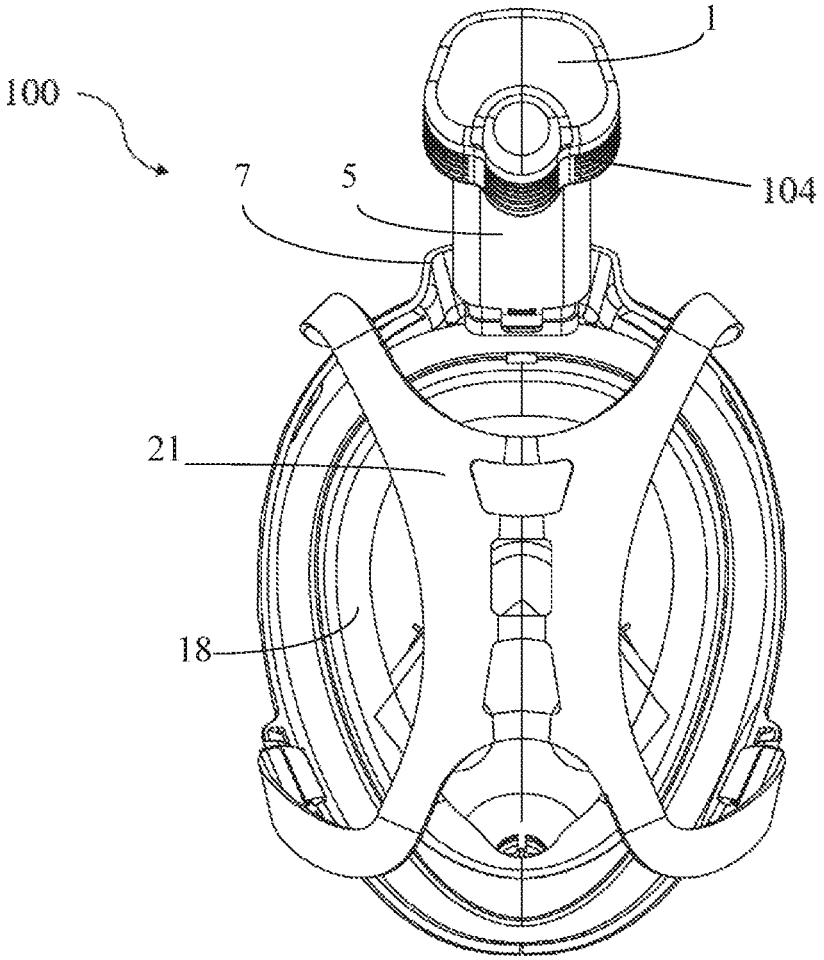
FIG. 14 is a rear view of the full-face diving mask including a headband.

FIG. 14 shows a state where the elastic headband 21 is connected to the outer frame 7. In addition, in some embodiments (such as that presented in FIG. 2), a water discharge port may be provided at a position on the lens housing 14 corresponding to the mouth. A valve plate 13, which is a one-way valve and a lower water discharge lid 12, are provided at the water discharge port (valve 13). When there is water within the mask 101, the water can be discharged through the water discharge port by the user under the water; while water cannot enter the inside of the mask 101 from the outside through the water discharge port. In addition, since the breathing tube is detachably connected to the mask 101, for example by snap connection, a sealing member such as an elastic ring is provided at a position where the breathing tube is connected to the mask 101 to prevent water from entering the mask 101. As shown in FIG. 2, the breathing tube 6 may be connected to the top connecting portion of the lens housing 14 by snap connection, and a sealing ring 22 is provided at the connection, so that water from the outside is less likely to enter the inside of the mask 101 via the connection, thereby reducing potential safety hazard.

While the invention has been described in detail in connection with a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

It should further be understood that the features illustrated in FIGS. 1 through 14 only show the alternative shapes, sizes and arrangements of various alternative components of the full-face diving mask according certain exemplary embodiments, which are merely illustrative and not restrictive. Other shapes, sizes, and arrangements can be employed without departing from the spirit and scope of the present disclosure.

It should also be understood that the lens housing according to the present disclosure may include a lens. The lens may be made of a transparent plastic material to provide a clear view under the water or be made of other suitable materials known in the art. In some embodiments, the lens may be a Plano lens (i.e., a lens with no vision correction but possibly tints or reflective coatings) or a lens with vision correction properties. However, the lens may also be a lens for short-sightedness or long-sightedness to accommodate the needs of different users. In the illustrated embodiment, the breathing tube is shown and described to have a fixed extension length. However, the breathing tube may also be provided as a telescopic tube, such that dive depth can be adjusted to meet the needs of different users. Thereby, the full-face diving mask of the present disclosure has a better applicability.

The technical content and technical features of the present disclosure have been disclosed above. However, it should be understood that numerous variations and improvements to the above disclosed concepts fall within the scope of protection of the present disclosure. The description for the above embodiments is illustrative and not restrictive, and the scope of protection of the present disclosure is determined by the claims.

What is claimed is:

1. A full-face diving mask, comprising:

a lens housing comprising a lens;

a fitting mask sealed to the lens housing at an interface and comprising a face opening configured to seal against a portion of a user's face;

a cavity formed by the lens housing and the fitting mask;

a first partition plate dividing the cavity into an upper air compartment and a lower air compartment;

at least one first valve configured to permit a transfer of air from the upper compartment to the lower air compartment and to prevent a transfer of air from the lower air compartment to the upper air compartment;

a second partition plate dividing the lower air compartment into a front lower air compartment located between the second partition plate and the lens housing and a rear lower air compartment located between the second partition plate and the face opening; and at least one second valve configured to permit a transfer of air from the rear lower air compartment to the front lower air compartment and to prevent a transfer of air from the front lower air compartment to the rear lower air compartment;

wherein a first floater member is disposed between and directly connected to a second floater member and a third floater member such that the first floater member, the second floater member, and the third floater member move together within a caged portion.

2. The full-face diving mask according to claim 1, wherein the first partition plate, the second partition plate, and the fitting mask together comprise a single, integral piece.

3. The full-face diving mask according to claim 2, wherein the lens housing comprises a valve configured to permit accumulated water in the rear lower air compartment to be discharged into an exterior environment and to prevent water in the exterior environment from entering the rear lower air compartment.

4. The full-face diving mask according to claim 1, further comprising a breathing tube comprising:

a first end connected to at least one of the lens housing and the fitting mask, and a second end comprising a breathing tube opening.

5. The full-face diving mask according to claim 4, further comprising:

an air intake passageway extending between the breathing tube opening and the upper air compartment and configured to permit air intake; and an air discharge passageway extending between the front lower air compartment and the breathing tube opening and configured to permit air discharge.

6. The full-face diving mask according to claim 5, wherein the air discharge passageway comprises at least one air discharge conduit extending adjacent to the interface between the lens housing and the fitting mask and from the front lower air compartment to the breathing tube.

7. The full-face diving mask according to claim 6, wherein the air intake passageway comprises at least one air intake channel extending along the breathing tube and in fluid communication with the upper air compartment, and the air discharge passageway further comprises at least one air discharge channel extending along the breathing tube and in fluid communication with the at least one air discharge conduit.

8. The full-face diving mask according to claim 7, wherein the at least one air discharge conduit comprises:

a first conduit section extending in a clockwise direction from the front lower air compartment and along the interface between the lens housing and the fitting mask to the breathing tube; and a second conduit section extending in a counterclockwise direction from the front lower air compartment and along the interface between the lens housing and the fitting mask to the breathing tube.

9. The full-face diving mask according to claim 8, wherein the at least one air discharge channel in the breathing tube comprises:

a first discharge channel section in fluid communication with the first conduit section; and a second discharge channel section in fluid communication with the second conduit section.

10. The full-face diving mask according to claim 7, wherein at least one of the lens housing and the fitting mask comprises a connecting sleeve configured to selectively couple to the breathing tube.

11. The full-face diving mask according to claim 10, wherein the connecting sleeve comprises:

an intake connector section configured to couple the at least one air intake channel of the breathing tube to the upper air compartment; and at least one discharge connector configured to couple the at least one air discharge channel in the breathing tube to the at least one air discharge conduit.

12. The full-face diving mask according to claim 11, further comprising a sealing ring disposed between the connecting sleeve and the breathing tube.

13. The full-face diving mask according to claim 5, wherein the breathing tube comprises an adjustment device disposed adjacent to the breathing tube opening and configured to prevent fluid from entering the air intake passageway and the air discharge passageway when the breathing tube opening is under water.

14. The full-face diving mask according to claim 13, wherein the adjustment device comprises:

the first floater member, disposed adjacent to an entry control point of the air intake passageway, the first floater member configured to seal the entry control point when the first floater member is underwater and to be displaced away from the entry control point when the first floater member is not underwater, thereby permitting air to travel through the entry control point of the air intake passageway; and the second floater member, disposed adjacent to an exit control point of the air discharge passageway, the second floater member configured to seal the exit control point when the second floater member is underwater and to be displaced away from the exit control point when the second floater member is not underwater, thereby permitting air to travel through the exit control point of the air discharge passageway.

15. The full-face diving mask according to claim 14, wherein the adjustment device further comprises:

a sealing plate; and an end cap coupled to the sealing plate;

wherein the sealing plate is disposed between the breathing tube opening and the end cap, and the sealing plate defining a first hole for the entry control point sized to seal against the first floater member and a second hole for the exit control point sized to seal against the second floater member.

16. The full-face diving mask according to claim 15, wherein the first floater member and the second floater member are both seated in the caged portion that overlaps at least a portion of each of the air intake passageway and the air discharge passageway, and wherein the caged portion defines a plurality of slots forming the breathing tube opening.

17. The full-face diving mask according to claim 16, wherein the sealing plate and the end cap together couple the air intake passageway and the air discharge passageway to the breathing tube opening through the first hole and the second hole.

18. The full-face diving mask according to claim 17, wherein the air discharge passageway comprises a second exit control point.

19. The full-face diving mask according to claim 18, wherein the first floater member is larger than the second floater member and the first floater member is larger than the third floater member.

* * * * *